US005938076A

United States Patent [19]

Ganzeboom

[11] Patent Number: 5,938,076

[45] Date of Patent: Aug. 17, 1999

[54] DISPENSER FOR AN AEROSOL CAN

[75] Inventor: Wilhelmus Everhardus Ganzeboom, Haarlem, Netherlands

[73] Assignee: Averyck Engineering Consultants B.V., Haarlem, Netherlands

[21] Appl. No.: 08/727,589

[22] PCT Filed: Apr. 20, 1995

[86] PCT No.: PCT/NL95/00146

§ 371 Date: Dec. 3, 1996

§ 102(e) Date: Dec. 3, 1996

[87] PCT Pub. No.: WO95/29106

PCT Pub. Date: Nov. 2, 1995

[30] Foreign Application Priority Data

Apr. 25, 1994 [NL] Netherlands ..... 9400660

[51] Int. Cl.[6] ..... B65D 83/14; B67D 5/06

[52] U.S. Cl. ..... 222/23; 222/52; 222/54; 222/63; 222/64; 222/649; 222/504

[58] Field of Search ..... 222/52, 54, 63, 222/64, 23, 645–649, 504; 239/70, 71, 73–76

[56] References Cited

U.S. PATENT DOCUMENTS

| | | | |
|---|---|---|---|
| Re. 34,847 | 2/1995 | Muderlak et al. | 222/649 X |
| 3,187,949 | 6/1965 | Mangel | 222/649 |
| 3,195,777 | 7/1965 | Hart | 222/647 |
| 3,351,240 | 11/1967 | Gray | 222/646 |
| 3,627,176 | 12/1971 | Sailors | 222/646 X |
| 3,666,144 | 5/1972 | Winder | 222/646 |
| 3,848,775 | 11/1974 | Possell | 222/649 |
| 3,974,941 | 8/1976 | Mettler | 222/646 |
| 5,055,822 | 10/1991 | Campbell et al. | 222/648 X |
| 5,449,117 | 9/1995 | Muderlak et al. | 222/646 X |

FOREIGN PATENT DOCUMENTS

| | | | |
|---|---|---|---|
| 681 038 | 12/1992 | Switzerland . | |
| 1335182 | 10/1973 | United Kingdom | 222/646 |
| 1531712 | 11/1978 | United Kingdom | 222/646 |
| 2 172 125 | 9/1986 | United Kingdom . | |
| 2 248 888 | 4/1992 | United Kingdom . | |

*Primary Examiner*—Kevin P. Shaver
*Attorney, Agent, or Firm*—Young & Thompson

[57] ABSTRACT

A dispenser to be fitted on the top of an aerosol can so as to atomize a very small quantity of the contents of the aerosol can at regular intervals automatically. An attachment having an electrically operated valve is secured to the aerosol can. Operation of the valve takes place via a controller which is supplied by power by a photovoltaic or solar panel. In this way, it is ensured that dispensing the desired material takes place only when there is sufficient light striking the solar panel.

4 Claims, 4 Drawing Sheets

DISPENSER FOR AN AEROSOL CAN

FIELD OF THE INVENTION

The present invention relates to a dispenser according to the preamble of claim 1.

A dispenser of this type is generally known from the prior art. A device that is, for example, used in public toilets for periodic dispensing of an air freshener. Aerosol cans of this type are also used in greenhouses and other locations where a dosage of, for example, a herbicide has to be dispensed periodically.

BACKGROUND OF THE INVENTION

Motor-driven systems are generally used in the prior art, which systems depress the conventional spray head of the aerosol can. Said motor-driven systems, together with the further circuitry and the aerosol can, are housed in a casing. The batteries for supplying the power for the control and drive of the motor are likewise located in said casing. In some embodiments the aim is to make the life of the batteries equal to the life of the aerosol can or to make the battery life twice that of the aerosol can.

In U.S. Pat. No. 3,666,144 an attachment is described which is to be placed between the atomiser nozzle of an aerosol can and the aerosol can itself. A coil-operated valve is contained in said attachment. With this embodiment the life of the batteries can be extended appreciably because current consumption is appreciably limited.

In practice this type of simultaneous use of the aerosol can and the batteries proves particularly difficult to realise. This means that either the aerosol can is not emptied completely or that the battery is not exhausted at the time the aerosol can is changed. Moreover, it is necessary for maintenance staff to replace both the aerosol can and the batteries.

Some embodiments have indicators to display the number of times aerosol has been dispensed by the aerosol can or the residual power in the battery. This counting is ineffective if the aerosol can contains a greater or lesser number of doses. One problem with the battery indicator is that as soon as the battery is virtually empty no further indication can be given of the contents of the aerosol can or the contents of the batteries themselves. That is to say, there is no clear indication for maintenance staff. A positive approach to this problem, that is to say allowing an indicator to remain permanently lit if the battery is not yet empty, is found to consume a particularly high proportion of the battery charge and this approach is therefore also not desirable.

A further problem is that, especially in public toilets, a separate circuit is needed to prevent a dosage also being dispensed during the night when the toilets are not in use. For this purpose it is necessary to set the time or to use a day/night sensor, which is complex and the reason why, in practice, devices of this type continue to run day and night, which leads to wastage of the both the contents of the aerosol cans and of the batteries.

OBJECT OF THE INVENTION

The aim of the present invention is to provide a dispenser which does not have the above disadvantages and operates only if the surroundings in which said device is located are in use and with which it is possible to give a direct indication of whether or not the device is in operation. independently of other effects of the surroundings, even when the aerosol can is almost empty.

SUMMARY OF THE INVENTION

This aim is achieved with a dispenser using a photovoltaic or solar cell.

Although the use of a photovoltaic or solar cell has been suggested before, a photovoltaic cell of this type has always been used in combination with an accumulator or other rechargeable battery having a relatively large capacity. This meant that such a solar cell served merely to keep the battery charged at the required level. A construction of this type is described, for example, in Netherlands Patent Application 8102234 in the name of the Applicant.

The disadvantage of this construction was that a particularly large surface area of solar cell was needed to operate the electric motor for the fan which was used with this arrangement. Moreover, it is not simple to make a differentiation between when the device is and is not in use, whilst, finally, there is no indication whatsoever as to whether a light level adequate for the solar cell is available. After all the accumulator used will be fully charged when it is installed. It will become clear only after some time that the accumulator used is discharging more energy to the motor than is being charged by the solar cell. At that point in time the installers are no longer on site.

With the device according to the invention a relatively small solar cell can suffice as a result of the use of the attachment having the valve mounted therein. The effect of the direct power supply from the photovoltaic cell and the accumulator, such as a capacitor, having a relatively small capacity to the valve is that no substantial dispensing takes place when, for example, the toilets are not in use, that is to say when the lights are off in the case of public toilets. Furthermore, the installers can establish immediately at the time of installation whether or not there is adequate light by checking whether atomisation starts at the desired point in time.

The various features can be further optimised in that the controller is provided with an indicator showing the light intensity. That is to say that, for example, a light emitting diode or the like which is illuminated when there is adequate light is located on the casing of the dispenser. The optimum positioning of the casing and, more particularly, of the solar cell mounted thereon, can then be taken into account immediately at the time of installation.

Furthermore, sensor means to sense the condition of charge of the aerosol can can be present, which means are connected to the controller according to the invention. As a result, a light signal, for example, can be given if the charge level falls below a certain level, which, for example, corresponds to the empty state of the aerosol can. Because the lowering of the contents of the can does not proceed in parallel with the energy emitted by the solar cells, it can, in contrast to the case with constructions which have batteries which become exhausted, be assumed with reasonable certainty that if the indicator is out there are no problems, whilst problems are to be expected when the indicator comes on.

These sensing mean can comprise several embodiments.

First of all it is possible to provide a pressure sensor which could be realised as a switch or other pressure sensitive element introduced in the aerosol can which will give a signal if the pressure in the aerosol can drops.

It is also possible to provide a gas sensitive switch near the outflow opening of the dispenser. If no gas or liquid from the aerosol can is sensed whilst the dispensing device is activated it can be concluded that the aerosol can is empty.

It is also possible to provide some kind of flap which is blown away by the discharging gas. Movement of this flap can be sensed. A further possiblity is to provide a tube inside a coil which coil is connected with the aerosol can. In this tube a metal part is provided which will move because of the pressure of the aerosol can and will result in a change of induction of the coil.

However, preferably in the outflow opening a temperature sensitive device such as a resistance is provided. If the aerosol can is activitated evaporated gas possibly comprising some evaporating liquid droplets move along the resistance resulting in its cooling. This gas is evaporated in prior art aerosol cans in the area of the outflow tube extending from the top of the aerosol can to its bottom.

However, if the aerosol can is nearly empty the gas will already evaporate in the can itself. In that case the gas will have a considerably higher temperature than in the condition wherein the gas is only (partially) evaporated in the tube extending into the can to the dispensing opening.

It will be clear that such a sensing device cannot only be used in the dispenser according to the invention but in combination with any other prior art aerosol can in which it is necessary to have indication whether or not it is still filled.

Any device to be provided outside from the aerosol can has the advantage that it has not to be changed together with the aerosol can if this can is empty.

According to an advantageous embodiment of the invention, position sensor means are fitted close to the part coming into contact with the top of the aerosol can in order to ensure that there is a complete connection between the aerosol can and the attachment.

To prevent incorrect aerosol cans being used in combination with the attachment described above, coupling means which engage with one another can be fitted on both the attachment and the aerosol can.

As indicated above, the aerosol can can spray any agent which has to be dispensed periodically, such as air fresheners and herbicides.

BRIEF DESCRIPTION OF THE DRAWINGS

The invention will be explained in more detail below with reference to an illustrative embodiment shown in the drawing. In the drawing.

DETAILED DESCRIPTION OF THE INVENTION

Figure 1:
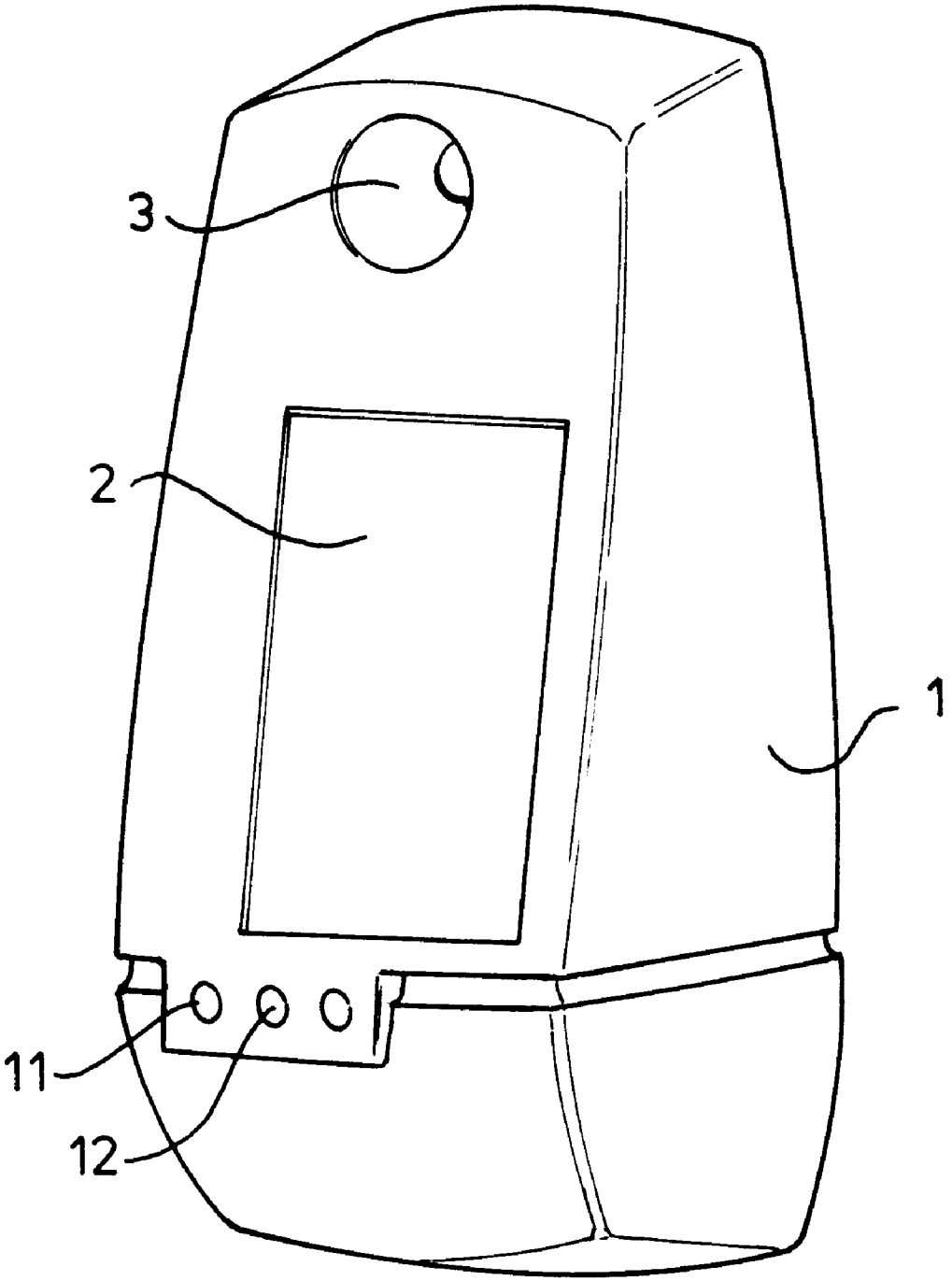
FIG. 1 shows a perspective front view of the exterior of the device according to the invention.

In FIG. 1, the holder for accommodating an aerosol can is indicated in its entirety by 1. A solar panel 2 is fitted on the front of said holder. There is also a dispensing orifice 3 for the medium to be dosed, and LED indicators 11, 12 are located on the lower side.

Figure 2:
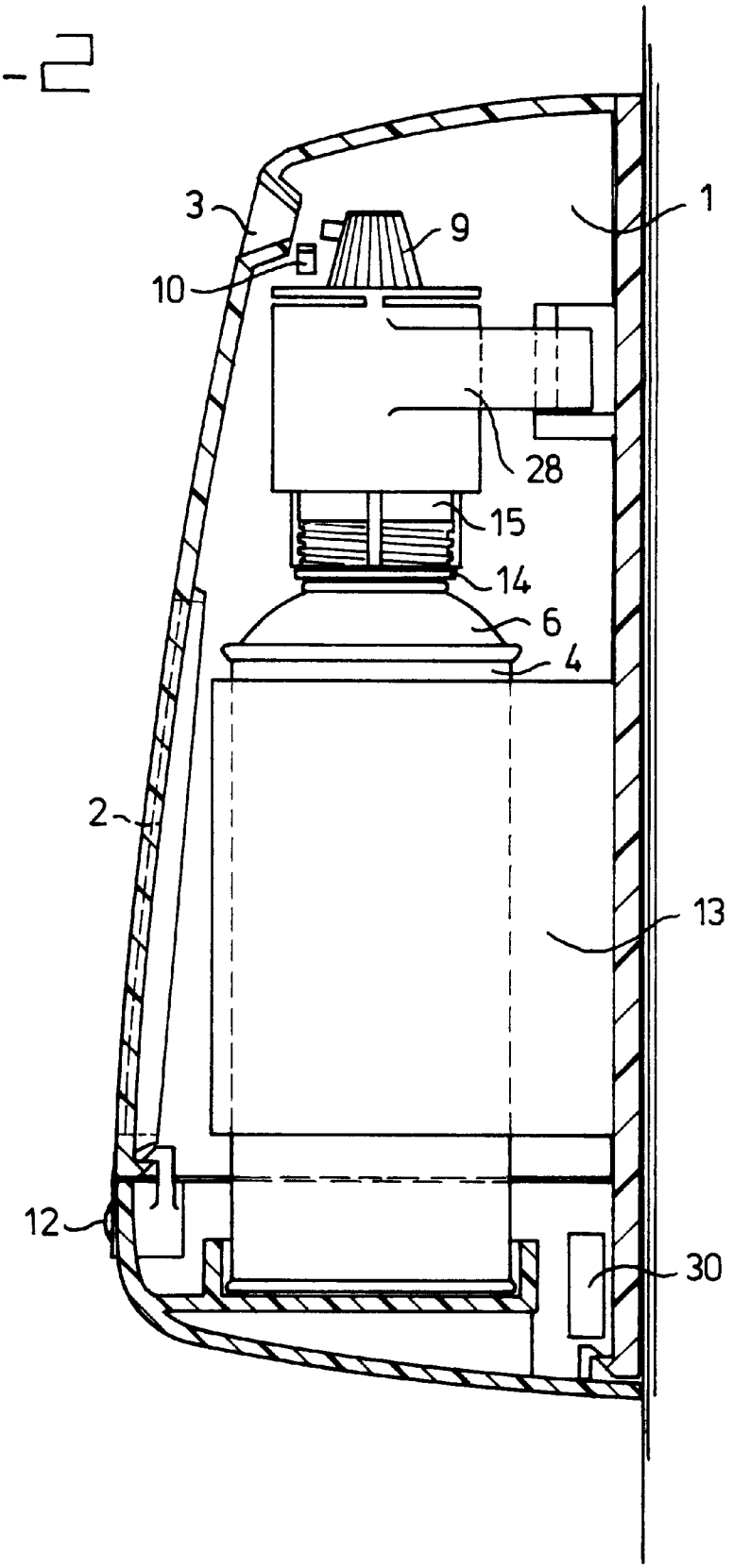
FIG. 2 shows a detail side view of the aerosol can in combination with the attachment according to the invention.

FIG. 2 shows a side view of the holder. It can be seen that the holder comprises a retainer 13 for an aerosol can, as well as diverse snap-shut means, which are not shown in more detail, for fixing to a base plate, which initially is fixed to the wall shown in FIG. 1. Constructions of this type are generally known from the prior art. Accumulator 30 is connected to controller 25 which is not shown in this figure.

Figure 3:
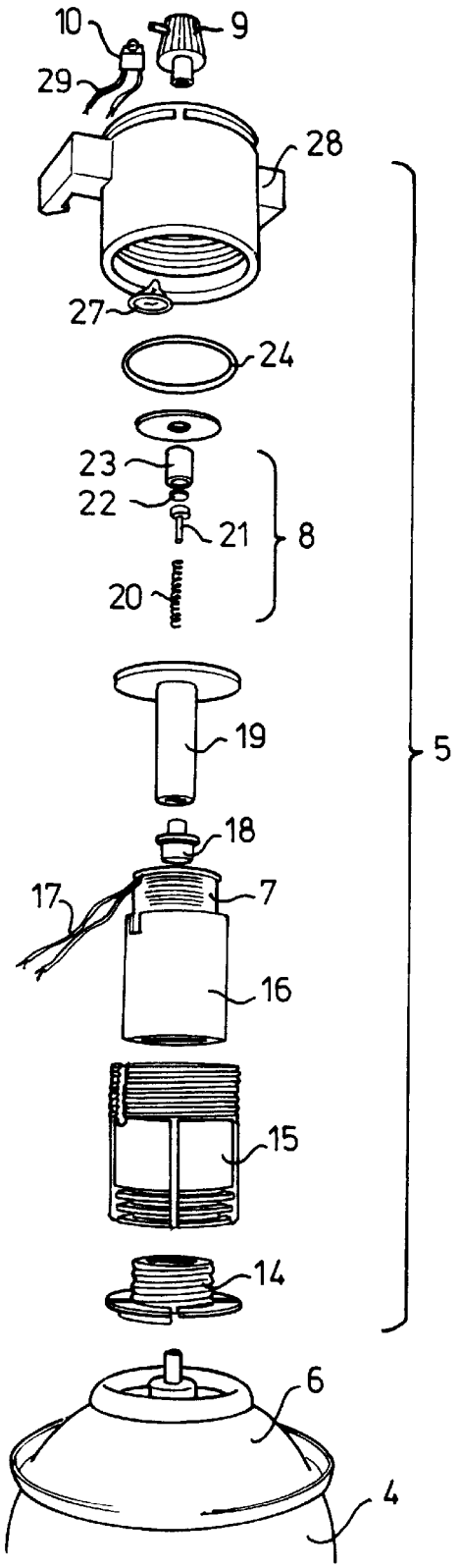
FIG. 3 shows an exploded view of the device according to the invention.

Retainer 13 is suitable for accommodating an aerosol can, only the upper part of which is shown in FIG. 3. The top 6 is designed to interact with an attachment 5, which is to be fixed thereto. This attachment 5 is shown in the exploded diagram in FIG. 3. It comprises, from bottom to top, an attachment/aerosol can coupling 14 and a valve housing 15, in which a coil housing 16 is accommodated. An electrically controllable coil 7, provided with lead 17, fits in coil housing 16. A propellant gas coupling 18 and a piston holder 19 are fitted inside coil 7. A valve 8, comprising a spring 20, piston 21, rubber seal 22 and piston housing 23, fits in the piston holder. A metal ring to intensify the magnetic field abuts piston housing 23. An O-ring 24 and pressure membrane 27 complete the valve device. A valve cover 28 interacts with the valve housing 15. On top of said valve cover 28 there is a dispensing nozzle 9 of the type generally known from the prior art. A temperature sensor 10 such as a NTC or PTC resistance can be fitted to be contacted with the gas flow from the aerosol can. This temperature sensor 10 is connected via lead 29 to the controller, which is not shown in more detail.

Figure 4:
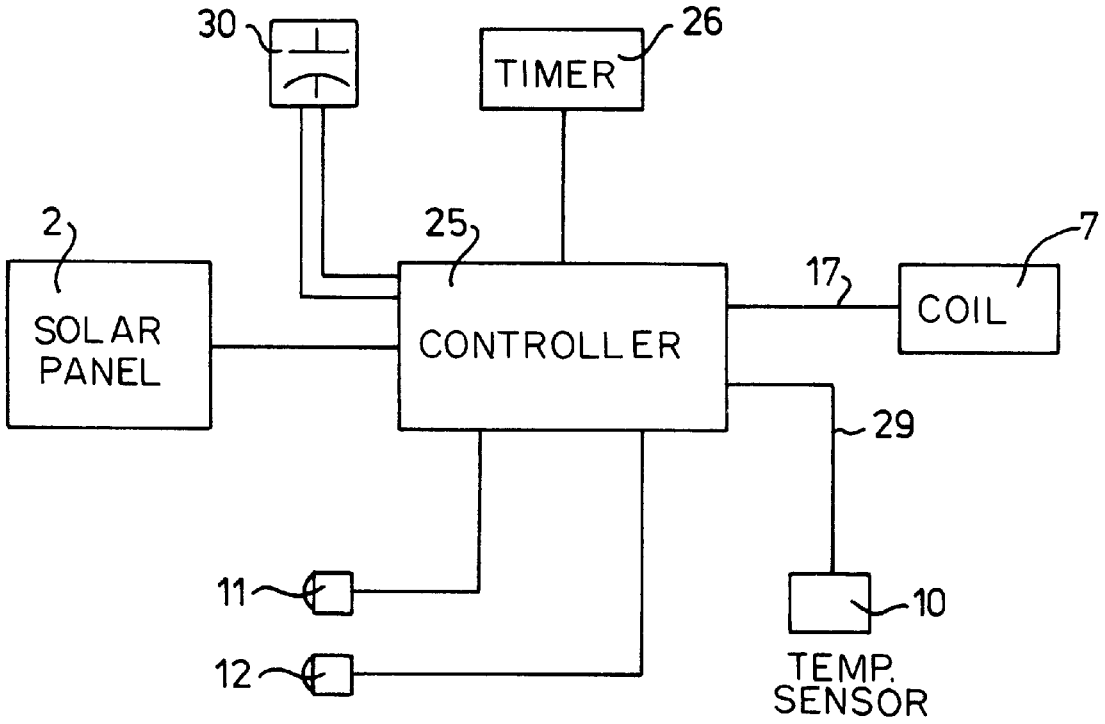
FIG. 4 shows the circuit diagram for the electrical connections and control of the various components.

The electrical connections of various components are shown diagrammatically in FIG. 4. The coil 7 of the valve is connected via lead 17 to controller 25. The same applies in the case of temperature sensor 10, which is connected to the controller 25 via lead 29. Controller 25 is likewise electrically connected to a timer device 26 and to the photocell 2. LED indicators 11 and 12 are also connected to the controller 25. An accumulator such as a capacitor 30 is provided.

The device described above functions as follows:

The installer will take account of LED indicator 11 when positioning the holder, containing aerosol can and other components fitted therein, in the lighted area concerned. When connected with controller 25 and photocell 2, said LED indicator 11 is so designed that a signal is given if sufficient energy is generated by the photovoltaic cell 2. The charge condition of accumulator 30 is not taken into account. During installation, the installer can immediately check whether there is adequate light to guarantee subsequent operation. It is, of course, also possible to dispense with said indicator and to use a light meter to carry out the various checks.

The device according to the invention is ready for use immediately after installation. Operation of the device is controlled by electricity from the photovoltaic cell 2. The timer circuit 26 is actuated by this means. Depending on the time which has been preset or is to be set after installation, said timer circuit 26 sends a pulse, the length of which can likewise be set for, for example, a few tens of milliseconds, to controller 25. In response to said pulse, energy originating from both photovoltaic cell 2 and accumulator 30 is transmitted to the coil 7 of valve 8. By this means valve 8 is actuated so that a small quantity of gas escapes from aerosol can 4. Valve 8 functions in the same way as the construction described in U.S. Pat. No. 3,666,144.

If the area concerned is not in use, that is to say the light is switched off or it is nighttime, energy will no longer be produced by the photovoltaic cell. This means that the controller 25 will function as long as sufficient charge is provided in accumulator 30. This is designed for about two dispensing operations. After that controller 25 is no longer functioning and, therefore, even if the timer device 26 were to emit a further signal this would have no effect on the operation of the coil 7 of valve 8.

The temperature sensor 10 measures the temperature of the outflowing gas from the aerosol can. If this temperature rises below a preset 'too high' value, such as the temperature when the can is empty, the high temperature signal is processed by controller 25 such that LED indicator 12 gives a signal. Consequently an indication that the aerosol can 4 has to be changed is available for maintenance staff.

This is based on the idea that in the aerosol a tube extends from the bottom to the nozzle through which the product to be dispensed is expelled because of propulsing gas, such as propane or butene. Evaporation of the liquid propulsing gas occurs either in this tube or near the discharge opening of either the aerosol can or the dispensing device. Anyway the temperature of the gas giving the dispensing device will drop in temperature which is sensed by sensor 10.

However, if the aerosol can becomes empty the last part of the gas will evaporate in the can itself resulting in a lower temperature drop of the gas at the discharge opening of the dispenser which will be sensed by senor 10. It has to be understood that such a sensing device can be used in combination with any other dispensing device known in the prior art. A temperature drop in the filled condition of the aerosol can of about 20° C. has been observed which is easy to sense.

Although the invention has been described above with reference to a preferred embodiment, it must be understood that numerous modifications can be made thereto without going beyond the scope of the present Application. For instance, it is possible to construct the valve/aerosol can coupling in such a way that, for example, an electrical connection is produced when the coupling is fitted correctly and a circuit is broken if said fitting is incorrect. In this way it is guaranteed that a dose is dispensed only when the fitting is correct. Moreover, the top of the aerosol can can be modified to make it possible to combine only specific types of aerosol cans with the attachment 5 according to the invention. Furthermore, the LED indicators can be replaced by audio indicators.

I claim:

1. In a dispenser for use with an aerosol can, comprising an attachment adapted to be placed on the top of an aerosol can, that attachment having a valve operated by a coil for dispensing contents of a said aerosol can, a controller connected to the coil to control movement of the valve, a timer circuit for the controller and a power supply for powering the coil; the improvement wherein the power supply comprises photovoltaic means for receiving ambient light and converting said ambient light into electric power, accumulator means connected to the photovoltaic means for accumulating said electric power and connected to said controller to supply the accumulated electric power from said accumulator means to said controller; said controller being arranged and constructed to power the coil only when there has been sufficient ambient light to charge said accumulator means from said photovoltaic means.

2. A dispenser as claimed in claim 1, wherein in the controller has an indicator indicating light and ambient light intensity.

3. A dispenser as claimed in claim 1, and temperature sensor means connected to the controller such that when the temperature of gas flowing from the aerosol can rises too high, the temperature sensing means causes the controller to give a signal that the aerosol can is to be changed.

4. A dispenser as claimed in claim 1, and a pressure sensor means connected to the controller to cause the controller to give an indication when the pressure of the outflowing gas from the aerosol can falls too low and falls below a predetermined minimum.

* * * * *